United States Patent [19]

Bouy et al.

[11] 4,115,239

[45] Sep. 19, 1978

[54] COATED ANODE

[75] Inventors: Pierre Bouy, Enghien-les-Bains; Dominique Ravier, Paris, both of France

[73] Assignee: Rhone-Poulenc Industries, Paris, France

[21] Appl. No.: 843,858

[22] Filed: Oct. 20, 1977

[30] Foreign Application Priority Data

Nov. 4, 1976 [FR] France ..... 76 33217

[51] Int. Cl.[2] ..... C25B 11/10; C25B 1/34

[52] U.S. Cl. ..... 204/290 F; 204/290 R; 204/291

[58] Field of Search ..... 204/290 R, 290 F, 291

[56] References Cited

U.S. PATENT DOCUMENTS

| | | | |
|---|---|---|---|
| 3,502,506 | 3/1970 | Broyde | 429/40 |
| 3,992,280 | 11/1976 | Zollner et al. | 204/290 F |
| 4,042,483 | 8/1977 | Bouy et al. | 204/290 F |

FOREIGN PATENT DOCUMENTS

| | | | |
|---|---|---|---|
| 1,164,477 | 9/1969 | United Kingdom | 204/290 F |
| 1,373,712 | 11/1974 | United Kingdom | 204/290 F |
| 1,391,625 | 4/1975 | United Kingdom | 204/290 F |

*Primary Examiner*—F.C. Edmundson

[57] ABSTRACT

An inexpensive anode coating for an electrolytic cell, having an outstanding stability and causing only a slight over-voltage, is provided. This anode coating is deposited on a valve metal and comprises a composition of cobalt oxide and titanium bronze, having the insertion of an alkali metal. The coating anode is useful in the electrolysis of alkali halides.

7 Claims, No Drawings

COATED ANODE

BACKGROUND OF THE INVENTION

The invention relates to a novel anode coating used on anodes in electrolytic cells and more particularly in cells for the electrolysis of alkali halides.

For some 20 years electrodes made from metals such as titanium and tantalum have been proposed and titanium anodes are, in fact, progressively replacing graphite electrodes in commercial sodium chloride electrolysis operations. These electrodes have a coating of precious metals such as platinum, iridium, ruthenium, etc., whose consumption during electrolysis, although low by weight, is not economically negligible due to the high price of these precious metals. A great deal of research has been carried out with the aim of substituting less noble metals for these very expensive metals, but none of the hitherto proposed solutions has led to industrial development, thereby demonstrating that they have not been very satisfactory. In particular, patent literature exists relating to perovskite coatings connected to the substrate by cobalt oxide, but the coating is still relatively expensive.

An anode coating has now been discovered which does not cause a significant over-voltage during electrolysis of an alkali halide and which has proved to be remarkably stable on contact with the electrolyte and the chlorine given off during electrolysis.

It is, therefore, an object of the present invention to provide a novel coating of anodes for use in electrolysis.

It is another object of the invention to provide novel anode coatings which have superior stability and do not cause significant over-voltage during electrolysis of alkali halides.

Other objects of the invention will be apparent to those skilled in the art from the present disclosure.

GENERAL DESCRIPTION OF THE INVENTION

The anode coating forming the subject matter of the present invention comprises a layer of a composition of cobalt oxide and of titanium and alkali metal bronze. The cobalt oxide is preferably the product formed by thermolysis of a cobalt salt and more particularly of cobalt nitrate.

The titanium bronzes used preferably contain as the insertion metal sodium and correspond to the formula $Na_xTi_8O_{16}$ in which $1.6 \leqq x \leqq 2$. The compounds have a clearly defined crystalline structure (monoclinic system). Research has been published on these bronzes and particular reference is made to "Nature," November 11th, 1961, article by Wadsley and Anderson, pages 551 and 552, and "Inorganic Chemistry," Vol. 6, No. 2, February 1967, article by Reid and Sienko, pages 321–324. The crystalline structure of these products permits a clear differentiation thereof from any solid solution of a titanium oxide and a random sodium oxide.

The process for the preparation of these compositions will be described in the examples.

The support on which the coating is deposited is a perforated structure or a plate and, in particular, a grating of a valve metal, preferably titanium, although other valve metals, such as tantalum, may be employed. The first coating of the substrate can be by a thin layer of cobalt oxide deposited, for example, by coating a cobalt nitrate solution which undergoes drying and then baking in an oxidizing atmosphere. This operation is repeated several times so as to obtain a cobalt oxide deposit preferably in a quantity between 1 and 3 mg./cm.$^2$, but this quantity is not critical for satisfactory results.

The outer, active coating comprises a mixture of bronze and cobalt oxide deposited from a suspension of said components. The cobalt oxide proportion can be between 20 and 80% of the total coating weight. Its weight per square centimeter of substrate area is preferably between 2 and 20 mg.

DETAILED DESCRIPTION OF THE INVENTION

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and throughout the specification, the quantities of material are expressed in terms of parts by weight, unless otherwise specified.

EXAMPLE 1

15.98 g. of sodium carbonate and 47.94 g. of titanium oxide (anatase) are weighed and ground, ensuring a homogeneous powder mixture. The thus obtained powder is pelletized by compression at 2 tons per square centimeter. The pellets are introduced into a platinum crucible and are baked at 1300° C. for 24 hours in the presence of air. The temperature is progressively increased at stages of one hour each at, respectively, 900°, 1000°, 1100° and 1200° C. The product is then pulverized and partly reduced by exposure to a gas consisting of a mixture of 15% by volume of hydrogen and 85% of argon. The resulting powder is purified by treatment at 80° C. using a mixture of equal quantities of normal solutions of hydrofluoric and sulphuric acids, in which bronze is insoluble. X-ray examination of this product reveals the crystalline structure which is characteristic of $Na_xTi_8O_{16}$. 1 g. of this bronze powder with a grain size between 1 and 10 microns is suspended with 1 g. of hexahydrated cobalt nitrate in a mixture of 1 ml. of water and 1 ml. of isopropanol.

The resulting suspension, homogenized by stirring which is continued throughout its use, is applied by means of a brush to a titanium plate which has previously been sandblasted, washed with pure water and dried. The plate coated with a suspension coating is dried for 5 minutes in the oven at 100° C. and then baked for 10 minutes in a furnace at 400° C. The coating, drying and baking operations are repeated 20 times. The coating quantity is approximately 16 mg./cm.$^2$ and contains approximately 20% by weight of cobalt oxide.

An electrode prepared in this way is used as the anode in a laboratory electrolytic cell. The electrolyte is a 300 g./l. aqueous sodium chloride solution, whose pH is approximately 4 and whose temperature is 85° C.

After operating for 2300 hours at a current density of 25 amperes per square decimater, the voltage of this anode is 1095 millivolts E.C.S., i.e., referred to a saturated calomel electrode.

COMPARATIVE EXAMPLE 1*a*

The titanium bronze is prepared as in Example 1. A suspension of 0.6 g. of this bronze powder and 1.70 g. of n-butyl-titanate in the same solvent quantities as in Example 1 is deposited in identical manner on a titanium plate which has also been sandblasted, washed and dried. The coating weight is approximately 10 mg./cm.$^2$ of electrode and the weight proportion of titanium oxide is 40%. Tested under the same conditions as those of Example 1, the anode formed immediately becomes passive, having a minimum E.C.S. voltage of about 2.4 volts.

EXAMPLE 2

A titanium plate cleaned by sandblasting, washed with ion-exchanged, purified water and dried is coated by means of a brush with a solution of 1 g. of hexahydrated cobalt nitrate in a mixture of 1 ml. of water and 1 ml. of isopropanol. After coating, the coated plate is dried for 5 minutes at 100° C. in an oven and is then kept in a furnace for 10 minutes at 400° C. These operations are repeated until a coating quantity of 2 mg./cm.$^2$ is obtained. The composition of titanium bronze and cobalt oxide is then deposited as in Example 1.

The thus prepared anode is placed in an electrolytic cell under the same conditions as for the previous examples. After 2500 hours, electrolysis with a current density of 25 amperes per square decimeter and 150 hours at 50 amperes per square decimeter, the electrode voltage is 1110 millivolts (E.C.S.).

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. An anode for an electrolytic cell having a coating, which coating comprises a composition of cobalt oxide and an alkali-metal titanium bronze.

2. An anode according to claim 1, wherein said titanium bronze has the formula $N_x Ti_8 O_{16}$ in which $1.6 \leqq x \leqq 2$ and it crystallizes in the monoclinic system.

3. An anode according to claim 2, wherein the proportion by weight of cobalt oxide is between about 20 and 80% of the total coating.

4. An anode according to claim 1, wherein the cobalt oxide is obtained by thermolysis of a cobalt salt.

5. An anode according to claim 1, wherein the cobalt oxide is obtained by thermolysis of cobalt nitrate.

6. An anode according to claim 1, wherein the cobalt oxide is prepared in situ.

7. An anode according to claim 1, wherein the proportion by weight of cobalt oxide is between about 20 and 80% of the total coating.

* * * * *